US008161788B2

(12) United States Patent
Köstermeier

(10) Patent No.: US 8,161,788 B2
(45) Date of Patent: Apr. 24, 2012

(54) METHOD FOR PRODUCING WORKPIECES

(75) Inventor: Karl-Heinz Köstermeier, Rheda-Wiedenbrück (DE)

(73) Assignee: REPKON Machine and Tool Industry and Trade Inc. (TR)

( * ) Notice: Subject to any disclaimer, the term of this patent is extended or adjusted under 35 U.S.C. 154(b) by 442 days.

(21) Appl. No.: 12/471,737

(22) Filed: May 26, 2009

(65) Prior Publication Data

US 2009/0288464 A1 Nov. 26, 2009

(30) Foreign Application Priority Data

May 26, 2008 (EP) ..... 08009558

(51) Int. Cl.
*B21D 17/02* (2006.01)
*B21B 19/08* (2006.01)

(52) U.S. Cl. ..... 72/370.01; 72/96

(58) Field of Classification Search ..... 72/80, 82, 72/84, 95, 96, 112, 367.1, 370.01
See application file for complete search history.

(56) References Cited

FOREIGN PATENT DOCUMENTS

| | | |
|---|---|---|
| DE | 19532953 | 3/1997 |
| DE | 102005057945 | 6/2007 |
| FR | 2190243 | 1/1974 |
| JP | 58202927 | 11/1983 |
| JP | 60145226 | 7/1985 |
| JP | 2002282949 | 10/2002 |

OTHER PUBLICATIONS

Search Report in EP 08 00 9558, Oct. 24, 2008, EPO.

*Primary Examiner* — Teresa Ekiert
(74) *Attorney, Agent, or Firm* — Bourque and Associates, PA

(57) ABSTRACT

A method for producing workpieces wherein a generally cylindrical preform (8) is formed by at least one pressure roller (7) into a finished workpiece (8.2). The method includes slidingly placing a portion of the preform (8) on at least a first mandrel (3, 4') which is slidably mounted in parallel with the longitudinal axis (A) of the preform (8), aligning the mandrel (3, 4') such that the surface (3*b*, 4*b*, 4*b'*) thereof disposed within the preform (8) substantially defines a negative profile of an inner surface to be formed in said preform (8), and performing a relative movement between the preform (8) and the pressure roller (7) in a direction parallel to the longitudinal axis (A) while pressing the pressure roller (7) against the preform (8) such that material of the preform (8) is displaced by the pressure roller (7) in such a way that the mandrel (3, 4') is moved by the displaced material.

16 Claims, 9 Drawing Sheets

METHOD FOR PRODUCING WORKPIECES

TECHNICAL FIELD

The invention relates to a method for producing workpieces and more particularly, a method for producing workpieces wherein a generally cylindrical preform is formed by at least one pressure roller into a finished workpiece.

BACKGROUND INFORMATION

One prior art method for producing workpieces is known from DE 10 2005 057 945 A1. In such methods, rotationally symmetrical preforms are processed by pressure rollers to produce various products, such as, for example, support rolls, automotive parts and gas bottles. In view of the stress such products are exposed to, it is desirable to stiffen certain areas as early as possible when being formed. In utilization such products, in particular central sections thereof, are subjected to a stronger stress, so material reinforcement is preferable in this area. Designs with concave or conical inner surfaces are particularly preferred, however, they cannot be produced by known flow-forming methods.

Accordingly, one object of the invention therefore is to provide a method of the above-mentioned character which enables the production of workpieces, from a perform, having a concave or conical inner surfaces.

SUMMARY

An object of the invention therefore is to provide a method of the above-mentioned character which enables the production of workpieces having a concave or conical inner surface, from a preform.

According to a first embodiment of the invention, the preform, preferably a cylindrical tube, is clamped onto the mandrel of a main spindle box and of a tailstock. The main spindle box and tailstock each have a tool case, which is concentrically disposed around the respective mandrel and provide for an external centering of the preform.

Both mandrels and tool cases are moveable in parallel to a machine axis and to the longitudinal axis of the preform, respectively. The mandrels each have outer surfaces tapering in one direction in such a manner to define a negative profile of the concave or conical inner surface to be formed in the preform. According to the invention pressure is applied upon the outer surface of the preform by one or preferably more pressure rollers. During this process the end faces of the pair of mandrels that face each other are kept engaged to each other. Mandrels and tool cases are moved such that material of the preform first flows into a space between tailstock mandrel and the associated tool case. Subsequently, the tool case of the main spindle box and the associated mandrel are moved such that material flows substantially towards main spindle box into the area of the outer surface of the associated mandrel such as to complete the workpiece with a concave or conical inner surface.

BRIEF DESCRIPTION OF THE DRAWINGS

These and other features and advantages of the present invention will be better understood by reading the following detailed description, taken together with the drawings wherein.

DETAILED DESCRIPTION OF THE EMBODIMENTS

FIGS. 1 to 6 schematically illustrate a flow-forming machine that may be used to implement the method according to the present invention.

Figure 1:
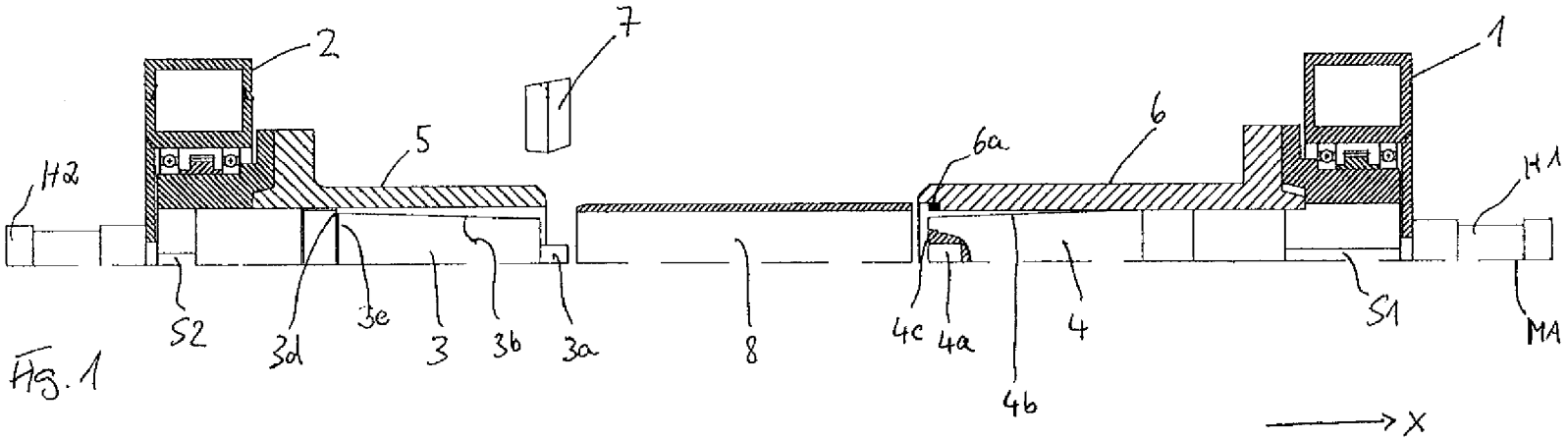
FIG. 1 shows a longitudinal section of a flow-forming machine adapted to implement the inventive method, with the preform being clamped and before the mandrels are moved to one another.
Figure 2:
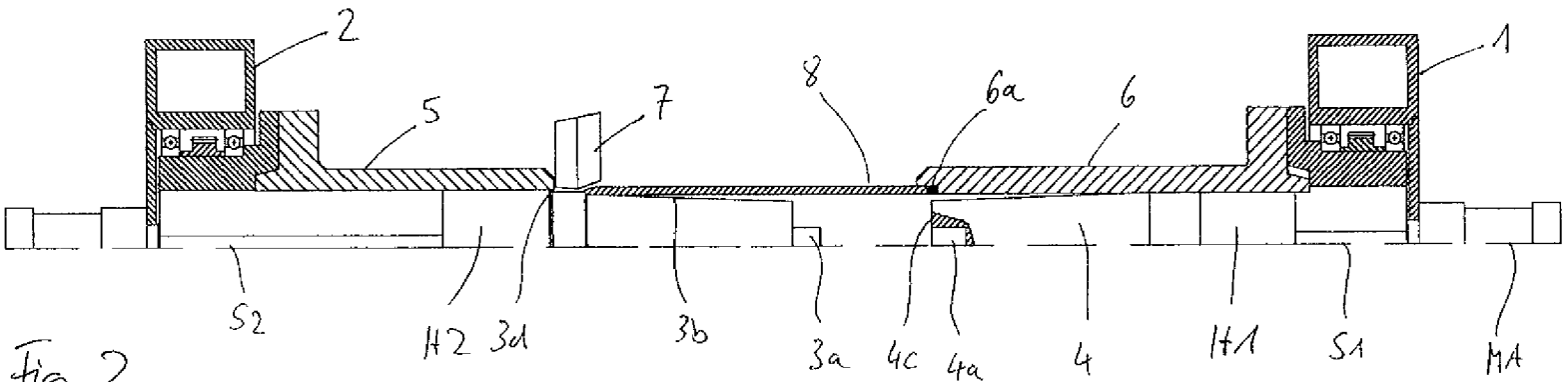
FIG. 2 shows the machine of FIG. 1, with the preform clamped and before moving the mandrels against each other.

The arrangement illustrated in FIG. 1 comprises a main spindle box 1 and a tool case 6 associated therewith, the tool case having a mandrel 4 that is axially moveably guided therein. Tool case 6 and mandrel 4 are arranged on a common longitudinal axis MA which extends through the center of main spindle S1 and tailstock spindle S2. Mandrel 4 may be moved axially relative to tool case 6 by a hydraulic cylinder H1. Both mandrel 4 and mandrel 3 are provided with a negative profile of the inner surface of finished parts 8.2*a* and 8.2*b*, the smallest diameters being provided in the plane of the end faces 3*c* and 4*c* of mandrels 3 and 4 facing each other.

Tool case 6 has a bore 6*b* opposite the main spindle support comprising a dog 6*a*. Bore 6*b* is of the same diameter as the outer diameter of preform 8 such that preform 8 may be accommodated by bore 6*b* in centered relationship with longitudinal axis MA. When preform 8 is inserted, FIG. 1, dog 6*a* first serves as an axial positioning means for preform 8. When, in the starting phase of the forming operation, preform 8 is pressed against dog 6*a* by mandrel 3 of the tailstock, dog 6*a* entrains preform 8 through tool case 6 when main spindle S1 rotates. During the forming operation the axial forming force of pressure rollers 7 provides this axial bias of the preform.

Depending on the size of preform 8 to be formed, tailstock 2 comprising tailstock spindle S2 and tool case 5 may additionally be provided with a drive running in synchronization with main spindle S1. The tailstock spindle and tool case 5 are arranged in and rotate about the center of common longitudinal axis MA.

Mandrel 3 is mounted in tool case 5 axially moveable by a hydraulic cylinder H2.

Depending on the type of the flow-forming machine, main spindle box 1 and tailstock 2 may be moved independently from each other relative to the axially positioned pressure rollers 7. In an alternative, a structural solution is to mount pressure rollers 7 such that they are moveable together by axial advance; in this case main spindle box 1 is fixedly mounted and tailstock 2 is moveably mounted. The latter solution is illustrated in FIGS. 1-6.

Mandrel 3 has an axial abutment face 3*d* and has towards its negative profile an outer diameter 3*e* that corresponds to the inner diameter of preform 8. When a preform 8 is received, mandrel 3 moves into preform 8 advanced by hydraulic cylinder H2, thereby centering the surface of preform 8 facing mandrel 3 by its outer diameter 3*e*, and pushes preform 8 into the outer centering 6*b* of tool support 6 described above to press it against dog 6*a* by applying axial pressure. In this operation phase, FIG. 2, the preform is supported in centered relationship manually or by an automated feeding means until clamping thereof is ensured.

Tool case 5, as illustrated in FIGS. 1-6, is only required if tailstock spindle S2 is driven. If tailstock spindle is not driven, mandrel 3 together with hydraulic cylinder H2 functions as a tailstock spindle. A corresponding embodiment is illustrated in FIGS. 7 to 12.

After preform 8 has been clamped (FIG. 2), mandrel 4 advances axially towards tailstock 2 by the advance of hydraulic cylinder H1 to form an entity together with mandrel 3. Thereby both faces 3*c* and 4*c* of mandrels 3 and 4 are pressed against each other, with the centering stud 3*a* of mandrel 3 plunging into centering bore 4*a* of mandrel 4. In this way the pair of mandrels 3 and 4 define the negative profile for the inner surface of the finished part. The total length of the two individual negative profiles 3*b*, 4*b* together corresponds to the length of the finished part which is formed from preform 8. In case that a cylindrical shape 8*c* having the diameter of interface 3*c* or 4*c* is provided between the individual negative profiles 3*b*, 4*b* and interface 3*c* and/or interface 4*c*, the length of the finished part increases by a corresponding amount.

Figure 6:
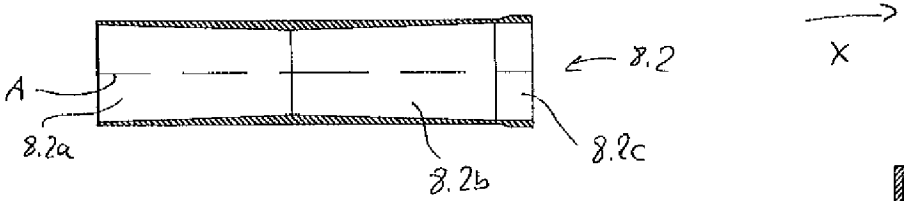
FIG. 6 shows the machine after removal of the finished part.
Figure 6:
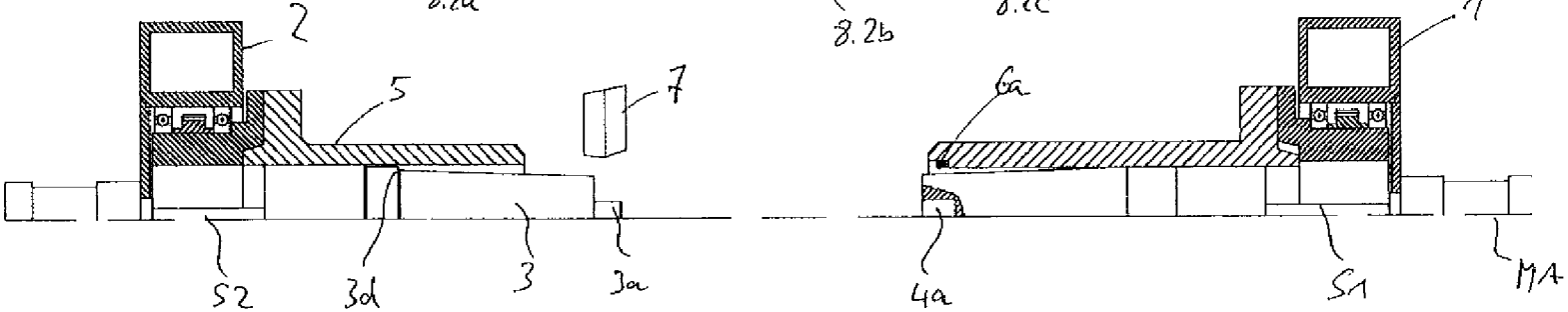
Figure 7:
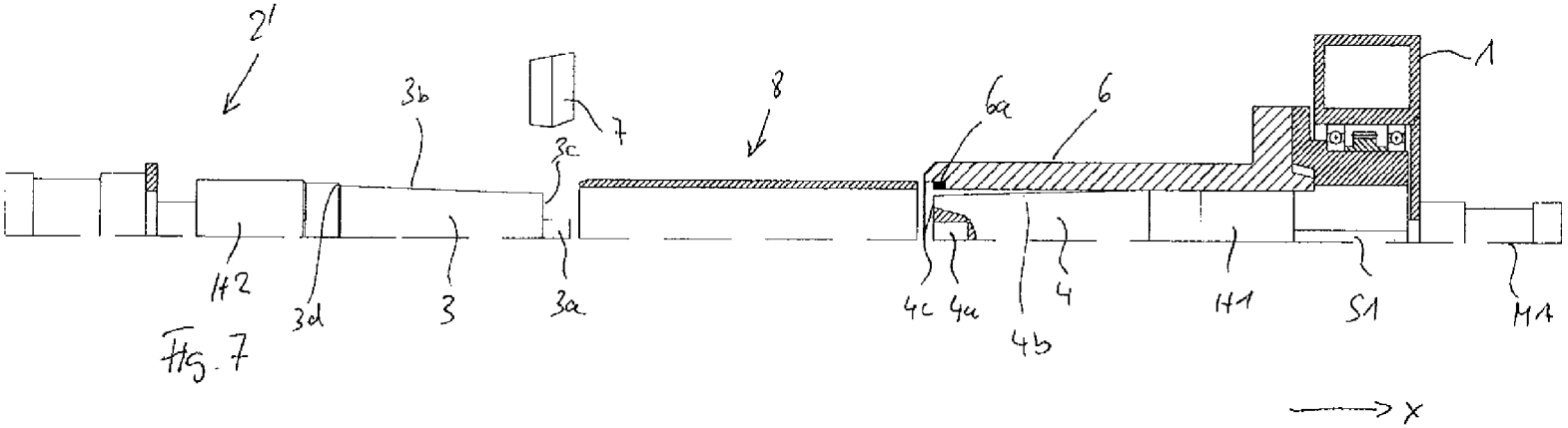
FIG. 7 shows another embodiment of the invention in a longitudinal sectional view of a flow-forming machine adapted to implement the inventive method, with the preform being clamped and before the mandrels are moved towards one another.
Figure 8:
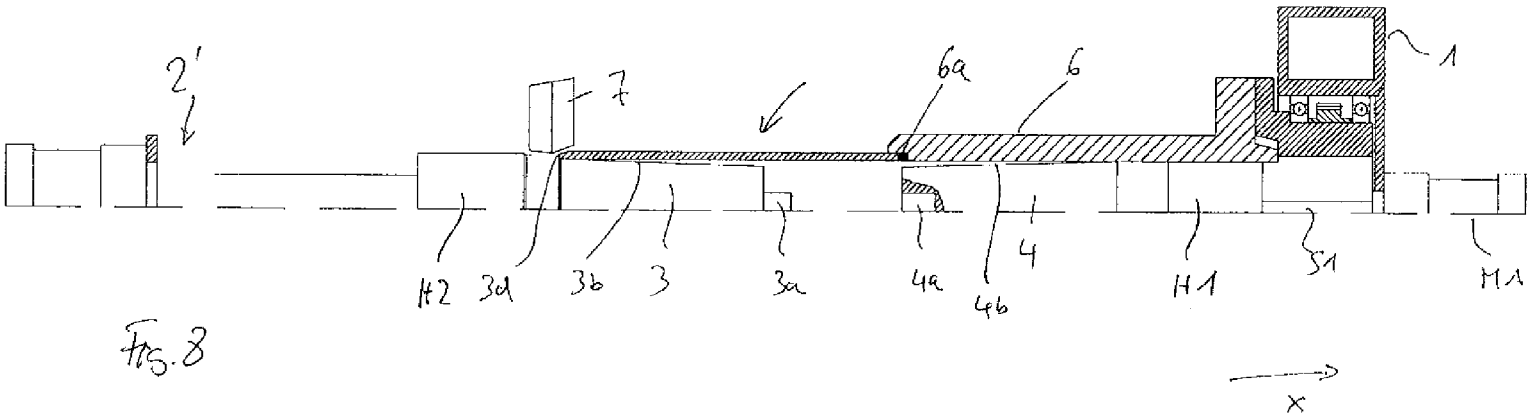
FIG. 8 shows the machine of FIG. 7, with the preform clamped and before moving the mandrels against each other.
Figure 9:
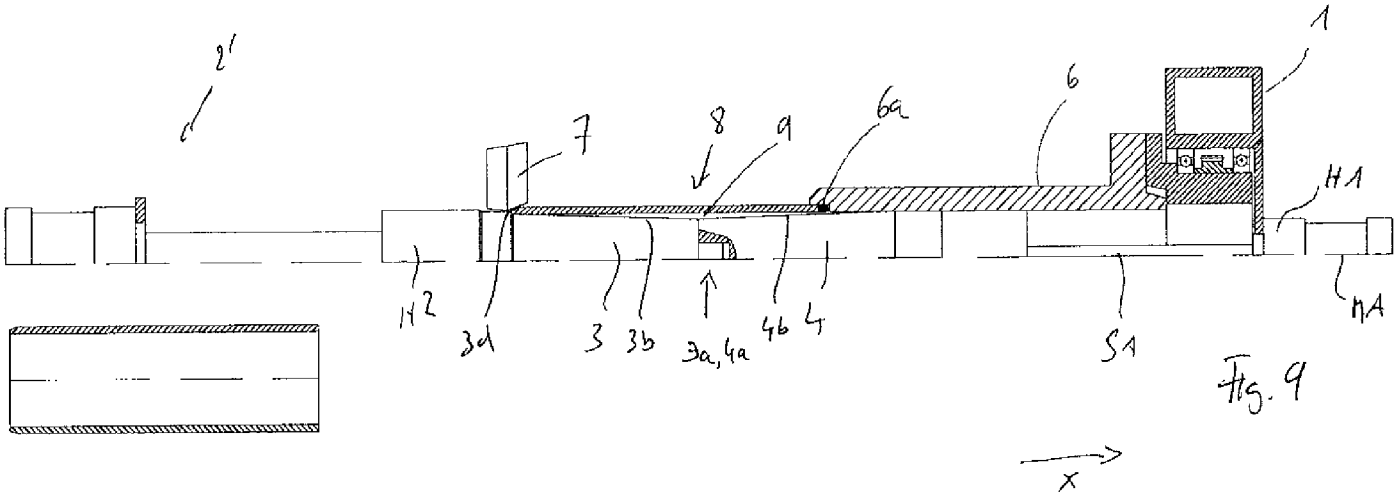
FIG. 9 shows the machine of FIG. 7 before forming of the process of preform according to the invention is started.
Figure 10:
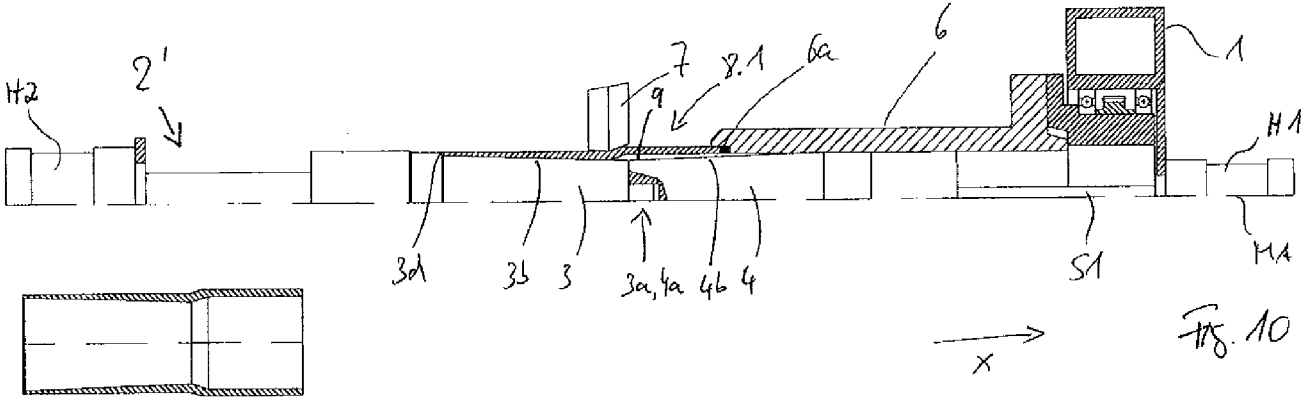
FIG. 10 shows the forming situation following forming of a portion of the preform.
Figure 11:
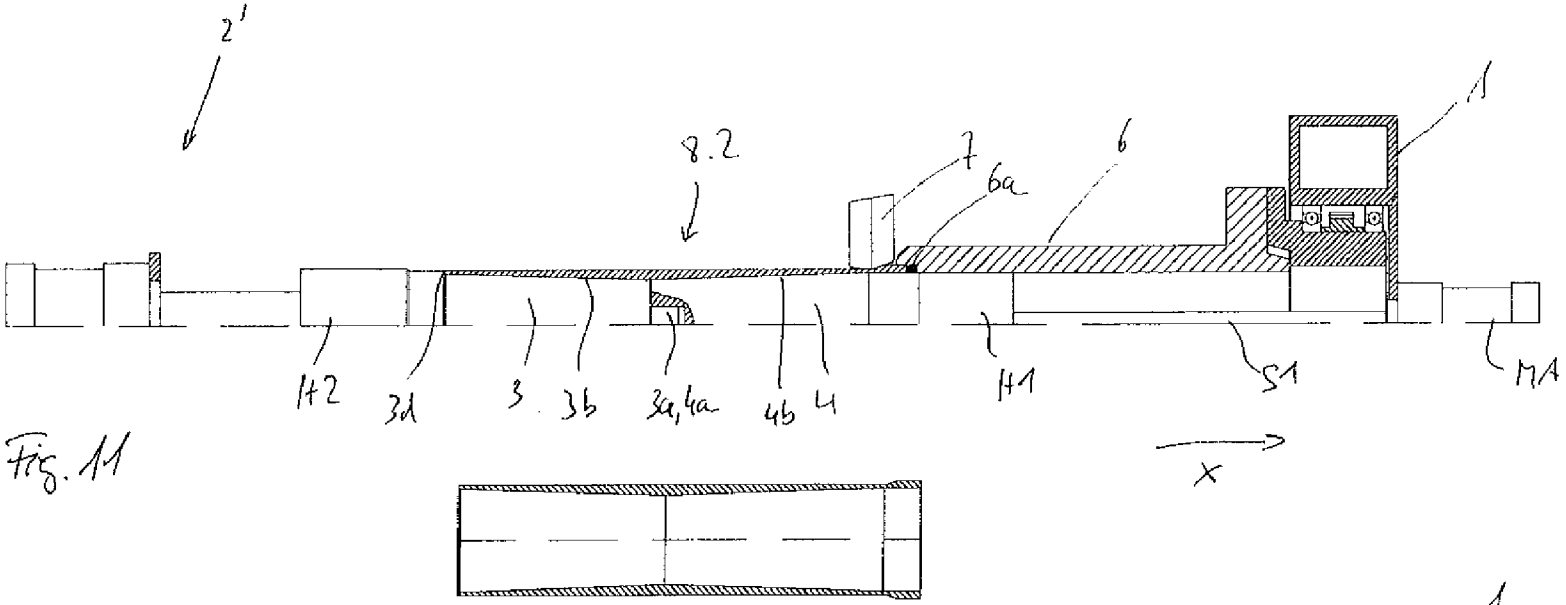
FIG. 11 shows the forming situation towards completion of forming the preform.
Figure 12:
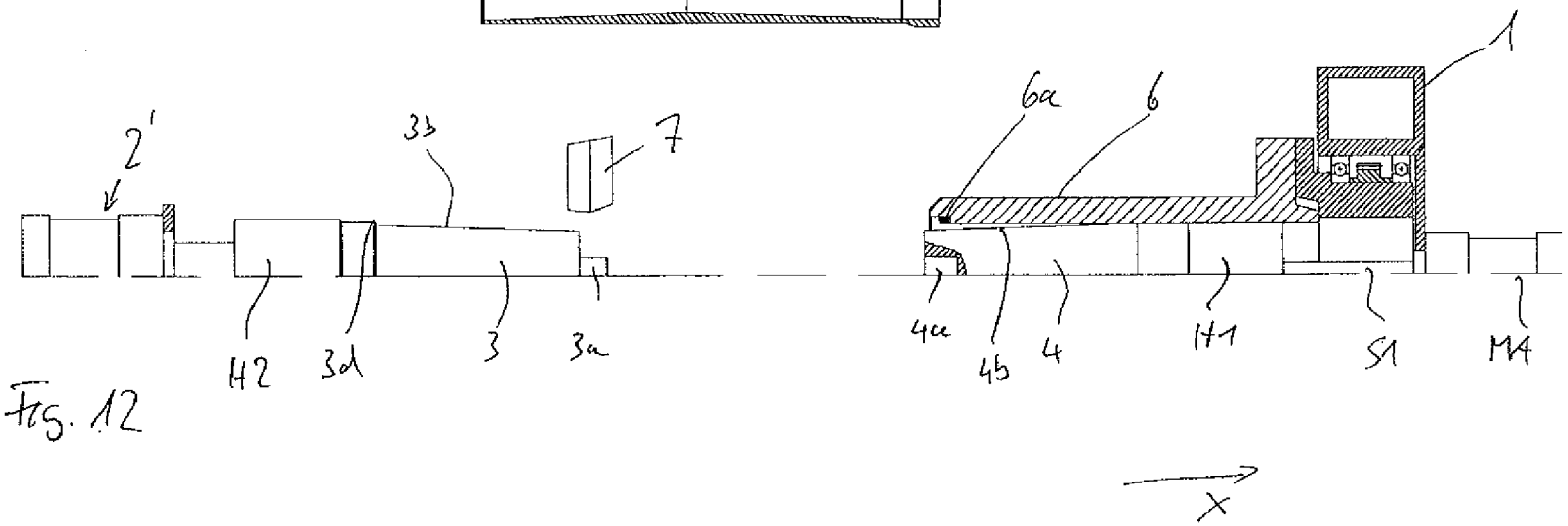
FIG. 12 shows the machine after removal of the finished part.
Figure 13:
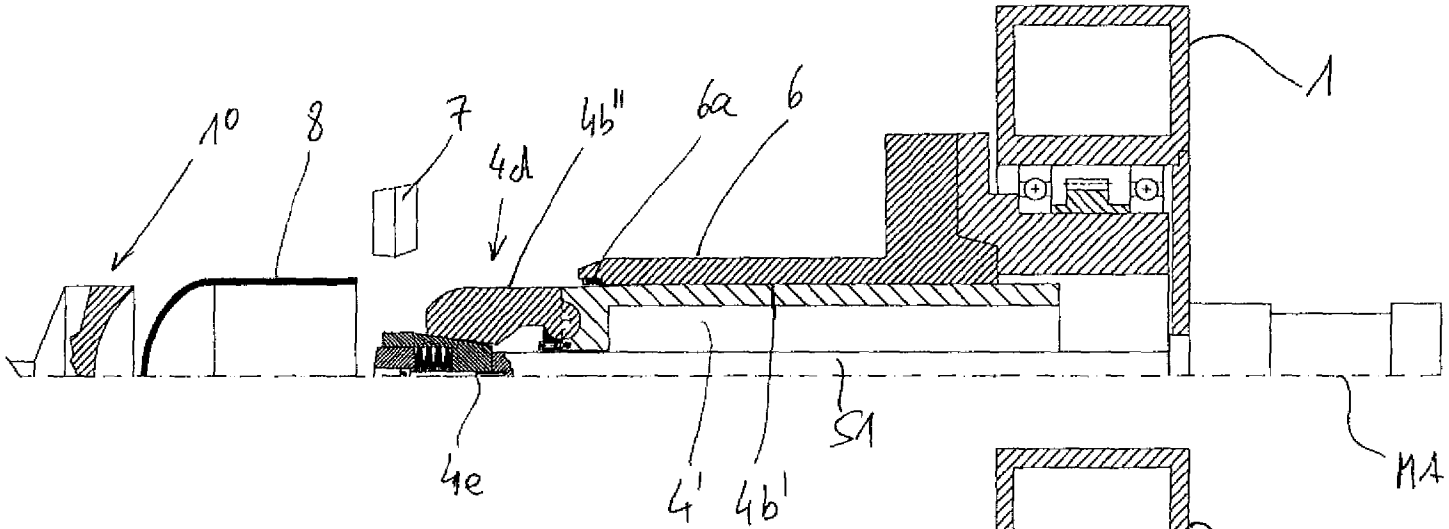
FIG. 13 shows a longitudinal sectional view of a third embodiment of the flow-forming machine according to the invention which is equipped with a spreading mandrel for production of bottles, before clamping the preform.

The same is true if, as illustrated in FIG. 6 at 8.2, a cylindrical shape 8.2*c* is provided in the area of the preform end at the main spindle side. Alternatively, it is possible to form an additional cylindrical profile 8*c* on the tailstock side.

Figure 3:
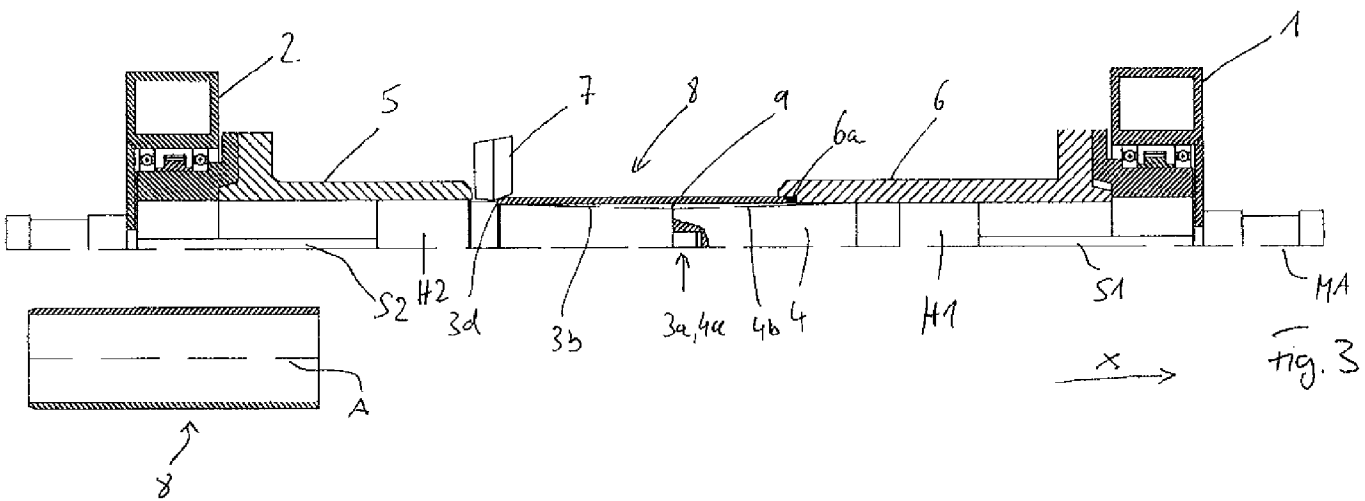
FIG. 3 shows the machine of FIG. 1 before forming of the preform according to the invention.
Figure 4:
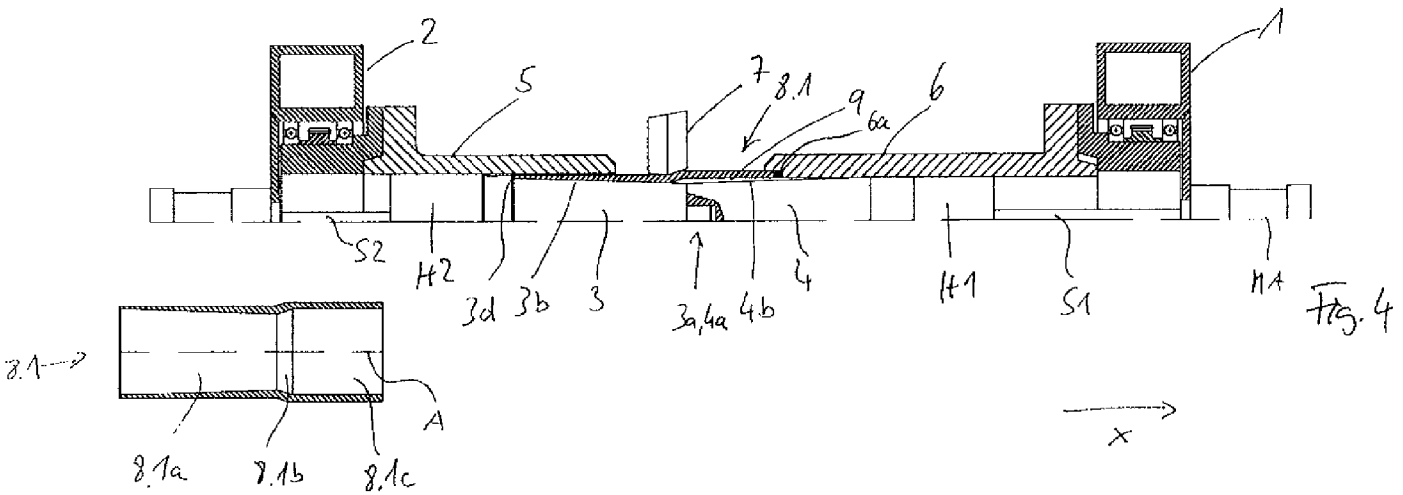
FIG. 4 shows the forming process following forming of a portion of the preform.

Pressure rollers 7 radially move into its position external of clamped preform 8, for subsequently moving together in axial direction against rotating preform 8, FIG. 3. Rotation of the assembly comprising preform 8, tool cases 5, 6 with mandrels 3, 4, main spindle S1 and tailstock spindle S2 is effected by the drive of main spindle S1 and, depending on the implementation type, additionally by the drive of tailstock spindle S2 running in synchronization therewith.

For the forming operation according to the invention one or preferably more pressure rollers 7 are provided around the periphery of preform 8. Pressure rollers 7 each have a peripheral inlet bevel in axial direction. In radial direction, pressure rollers 7 are in the position of an outer diameter of the finished part 8.2 to be achieved by flow-forming preform 8. As pressure rollers 7 that are positioned around the center of longitudinal axis MA of main spindle S1 are advanced together by a common advance in axial direction x towards rotating preform 8 they are caused to rotate when engaging preform 8. The axial and radial pressure exerted by pressure rollers 7 cause the material of the preform to flow in the area between pressure rollers 7 and, initially, the respective axial sectional plane of mandrel 3, FIG. 4. The material migrates into the space 9 provided between mandrel 3 and pressure roller 7 and, after having filled the volume of space 9, FIG. 5, evades towards tailstock 2 adopting the outer diameter set for the finished part 8.2, and the inner diameter defined by mandrel 3. Because of axial abutment 3*d* at mandrel 3 of tailstock 2, mandrel 3 is entrained by the flowing material as long as displaced material flows back. As such, tolerances in the diameter of preform 8 only reveal in the length of the formed workpiece 8.2.

Since mandrels 3, 4 are coupled in assembly, they are pushed together towards tailstock 2 by the displaced material when pressure rollers 7 together move towards main spindle box 1. By this material displacement finished part 8.2 is produced from preform 8 with an outer diameter reduced in comparison to that of preform 8, and with the shape of the pair of mandrels 3, 4 at the inner diameter.

Figure 5:
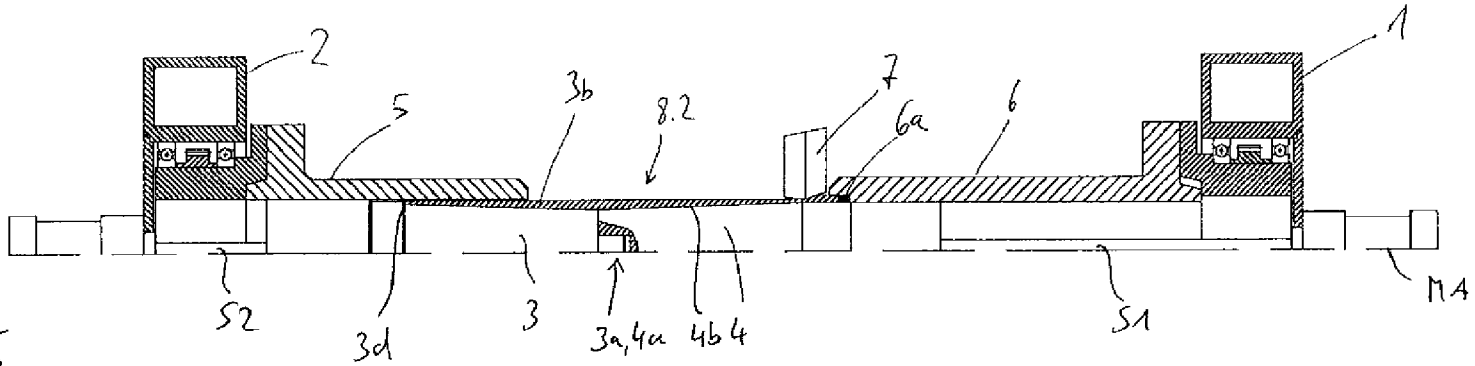
FIG. 5 shows the forming process towards completion of forming the perform.

The forming operation is completed when pressure rollers 7 arrive in the proximity of external centering 6*b* for the preform, FIG. 5. Then, the individual pressure rollers 7 return to their radial start position and return together to their axial start position. Mandrel 4 of the main spindle side is decoupled and retracted from formed workpiece 8.2, as is mandrel 3 of the tailstock side. To do this, an externally acting wiping means is provided, if necessary. By retraction of tailstock 2 workpiece 8.2 as formed is released, FIG. 6.

Workpiece 8.2 as formed is characterized by a reduced outer diameter and by an inner diameter with the shape of the contour of the pair of mandrels 3, 4.

The method according to the invention uses concave, conical and cylindrical contours of the mandrels. Since the mandrel or the assembly of two mandrels is moved by the flow of exceeding material arising from the reduction in width of the preform to the width of the finished part during the forming operation which implies a flow of material, there is no relative movement between the inner surface of the workpiece and the mandrel.

Only in the case of exceeding material the mandrel wanders axially towards a degree of freedom. That means, the material being formed axially revolves upon the mandrel and only pushes the same forward if there is enough material. As such, there is no relative movement between mandrel and material but only a revolving action in axial direction in correspondence to the contour. This revolving action of the material in the area of the pressure rollers may be promoted, or impeded, by controlling hydraulic pressure in cylinders H1 and H2.

This revolving action of the material also prevents a so called scuffing to occur during forming between both elements, the material and the mandrel's outer surface.

Tolerances in the range of the preform are accommodated by the displaced material without influencing the structure of the finished part, i.e. different wall thicknesses of the preforms do not affect the wall thickness of the finished workpiece formed by the flow-forming operation; the material only continues to flow if the wall thickness predetermined for the finished part is achieved in the respective axial plane. Therefore, only the length of the formed workpiece is prevalently afflicted with tolerances. The flowing rate of the material due to the reduction of width in the respective axial plane of the preform to the width of the respective axial plane of the finished part is defined by the excess of material and the advance rate of the pressure rollers. That means, the axial rate of the movement of the assembly of the pair of mandrels depends on the reduction in width of the preform in the respective axial plane, assuming a constant advance rate of the pressure rollers.

Thus, the method enables various shoulders, steps and contours to be formed at the inner surface of a rotationally symmetrical hollow body, if these steps, shoulders and contours taper in diameter towards the intersection of the coupled mandrels.

This is also true, if only the tailstock side mandrel is used. Further, the method may be employed, if only a portion of the rotationally symmetrical body along the longitudinal direction is formed and used, employing one single or two mandrels.

Thus it is possible to form a so called beam supported on two supports which exhibits a constant section modulus, in function of the stress the workpieces will be subjected to.

The characteristics of the workpieces produced from cylindrical preforms according to the method of the invention are particularly useful for gas bottles and supports. rolls.

FIGS. 7 to 12 show a second embodiment of the flow-forming machine according to the invention. The only difference to the arrangement of FIGS. 1 to 6 is that tailstock side 2' has the function of a tailstock spindle described above, there being no tool case provided on the tailstock side and just mandrel 3 being mounted moveable in axial direction x through a hydraulic cylinder H2. During the forming operation mandrel 3 is pushed back towards tailstock side 2' against the force of the hydraulic cylinder due to the flow of material. Otherwise, the method is analogue to the method described above in conjunction with FIGS. 1 to 6.

FIGS. 13 to 17 illustrate an alternative embodiment. In contrast to the embodiments described above this arrangement only requires one spreading mandrel 4' which is provided on the main spindle side. This alternative is contemplated in particular for forming cylindrical preforms 8 having one closed end, such as gas bottles.

Spreading mandrel 4' has a portion approximately corresponding to the mandrel 4 of the above embodiments having a tapered or conical outer surface 4*b'* and, adjacent thereto, a spreading portion 4*d* which has outer surface portions 4*b"* that may be inclined relative to the machine axis MA through a spreading mechanism 4*e* in such a way that this portion substantially adopts the shape of mandrel 3 of the above embodiments.

Figure 14:
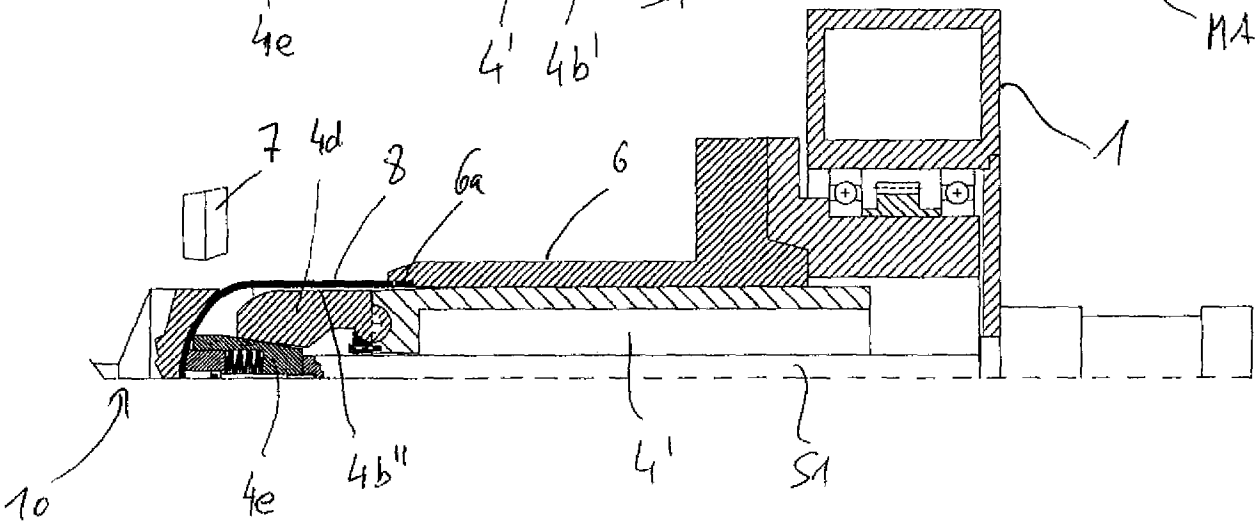
FIG. 14 shows the machine of FIG. 13 with the preform clamped thereon.
Figure 15:
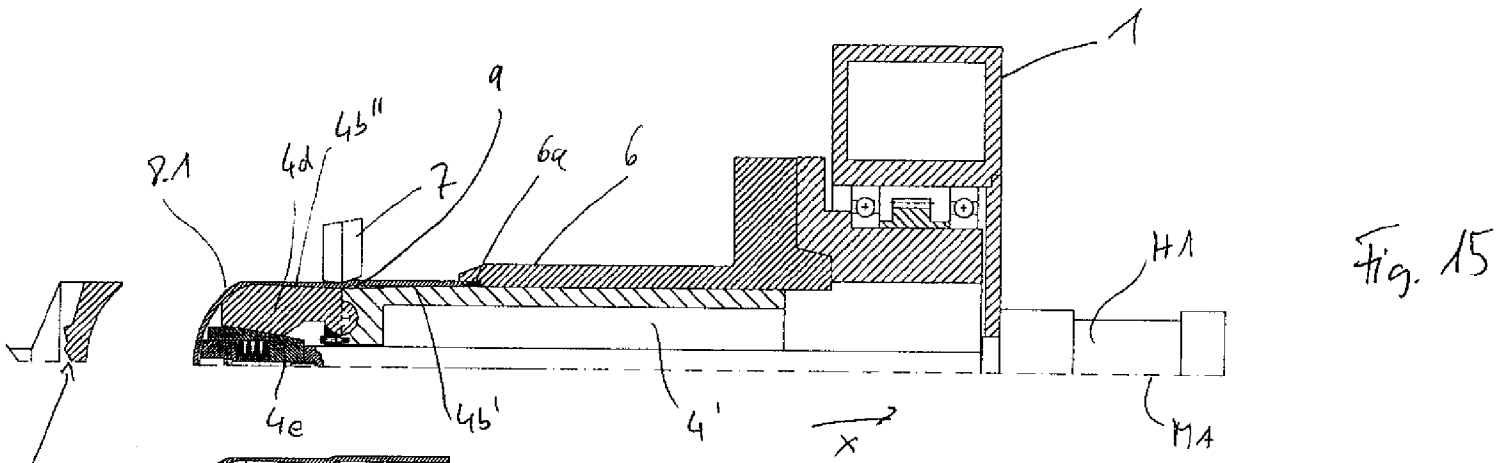
FIG. 15 shows the machine of FIG. 13 in a forming mode after forming a portion of the preform.
Figure 16:
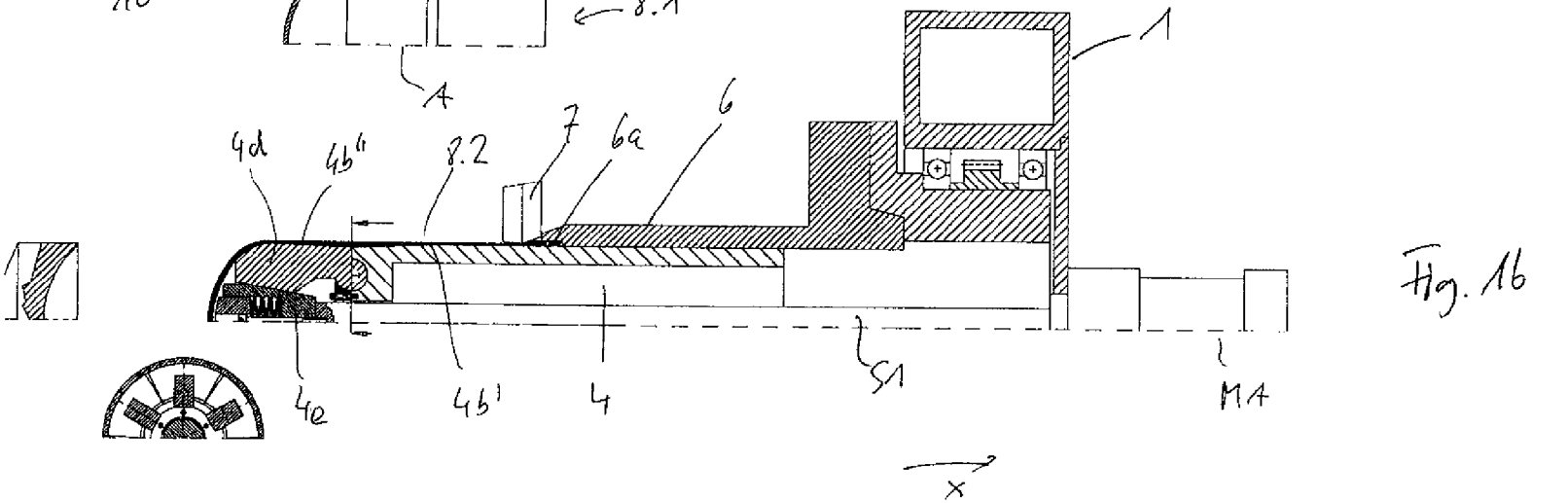
FIG. 16 shows the forming mode towards the end of the forming operation of the preform.
Figure 17:
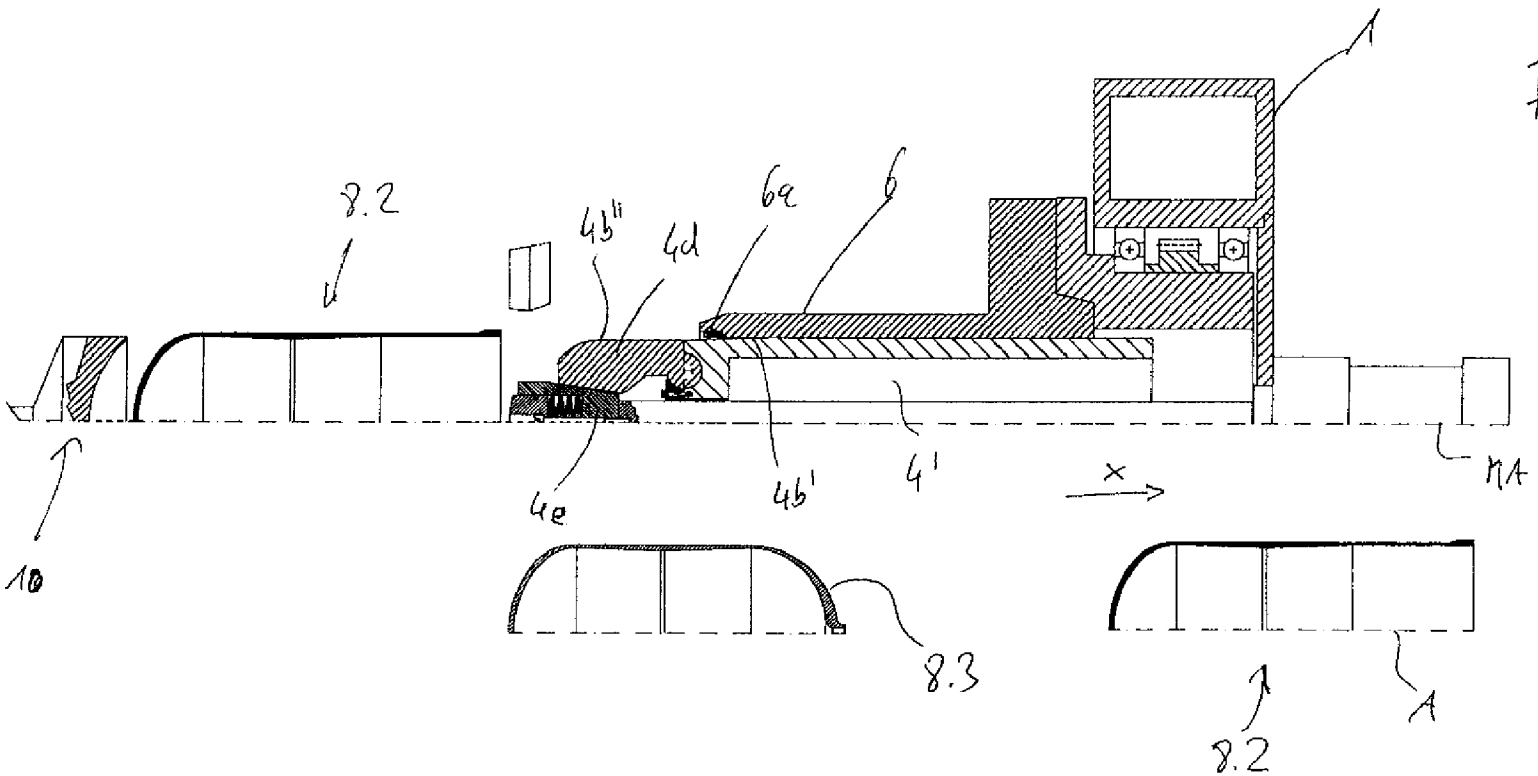
FIG. 17 shows the machine with the finished workpiece being removed.

First, preform 8 is slidingly placed upon spreading mandrel 4' with its open side ahead, with a pusher means 10 engaging the closed end of preform 8 opposite to mandrel 4' and pushing the same onto tool case 6 of main spindle box 1 until abutment 6*a*, FIG. 14. Pusher 10 biases preform 8 against abutment 6*a* so portion 4*f* of mandrel 4' may be spread by means of spreading mechanism 4*e* such that the above mentioned space 9 is defined by surfaces 4*b'* and 4*b"* between the inner wall of preform 8 and mandrel 4' which corresponds to the negative profile of the inner surface to be formed. During the forming operation of the pressure rollers, again, material from preform 8 is urged into space 9 thereby displacing mandrel 4', FIGS. 15 and 16. Once the forming operation is completed the finished shape 8.2 is removed following retraction of mandrel 4', FIG. 17, and the open end of shape 8.2 may be further processed, e.g. to produce a gas bottle 8.3.

In the described embodiments, the deformation through flow-forming occurs in two directions, namely in radial direction by a reduction of the outer diameter of preform 8, and in axial direction by shaping a cylindrical part with the new, reduced outer diameter. In this process, pressure rollers 7 advance in direction of main spindle box 1 while preform 8 rotates. This causes the material displacement to occur in helical manner and hence a distribution of the displaced material both in axial and in peripheral (tangential) direction of mandrel 3, 4, 4'. This is due to a material displacement from a larger diameter to a smaller diameter during rotation of the material.

The material flows radially, towards the smaller diameter of mandrel 3, 4, 4' to fill the space; tangentially, due to the rolling displacement through rotation with a concurrent advance in axial direction; and axially, opposite to the advance movement, if there is a sufficient excess of material.

If, in this situation, mandrel 3, 4, 4' is radially prevented from rotation, the material has to displace in peripheral direction of the mandrel relative to mandrel 3, 4, 4'. On a fixed mandrel, this causes a movement of the formed body to occur relative to the body of preform 8.

According to a preferred embodiment mandrel 3, 4, 4' is freely movable both in peripheral and in axial direction; as such it is able to freely adapt its movement to the displacement of the material being formed in both directions, by the contact therewith. This implies a relative movement in peripheral direction in the area of no contact between preform 8 and mandrel 4, 4' on the main spindle side.

List of reference numerals:

| | | |
|---|---|---|
| 1 | main spindle box | |
| 2 | tailstock | |
| | 2' | tailstock spindle |
| 3 | tailstock mandrel | |
| | 3a | stud |
| | 3b | surface of tailstock mandrel |
| | 3c | end face of tailstock mandrel |
| | 3d | abutment face |
| | 3e | centering diameter of tailstock mandrel |
| 4, 4' | main spindle mandrel | |
| | 4a | bore |
| | 4b, 4b', 4b" | surface of main spindle mandrel |
| | 4c | end face of main spindle mandrel |
| | 4d | spreading portion |
| | 4e | spreading mechanism |
| 5 | tailstock tool case | |
| 6 | main spindle tool case | |
| | 6a | dog |
| 7 | pressure roller | |
| 8 | preform | |
| 8.1 | machined preform | |
| | 8.1a | first portion |
| | 8.1b | transition portion |
| | 8.1c | third portion |
| 8.2 | finished workpiece | |
| | 8.2a | first portion |
| | 8.2b | second portion |
| | 8.2c | third portion |
| 9 | space | |
| 10 | pusher means | |
| A | longitudinal axis of preform and workpiece, respectively | |
| MA | longitudinal axis of flow-forming machine | |
| S1 | main spindle | |
| S2 | tailstock spindle | |
| H1 | main spindle box hydraulic cylinder | |
| H2 | tailstock hydraulic cylinder | |
| 8.3 | gas bottle | |

The present invention is not intended to be limited to a device or method which must satisfy one or more of any stated or implied objects or features of the invention and should not be limited to the preferred, exemplary, or primary embodiment(s) described herein. Modifications and substitutions by one of ordinary skill in the art are considered to be within the scope of the present invention, which is not to be limited except by the allowed claims and their legal equivalents.

The invention claimed is:

1. A method for producing workpieces wherein a generally cylindrical preform (8) is formed by at least one pressure roller (7) into a finished workpiece (8.2), said method comprising the steps of:

a. slidingly placing at least a portion of the preform (8) onto at least a first mandrel (3, 4') which is slidably mounted in parallel with a longitudinal axis (A) of said preform (8), b. aligning said mandrel (3, 4') such that a surface (3*b*, 4*b*; 4*b'*) thereof disposed within said preform (8) substantially defines a negative profile of an inner surface to be formed in the preform (8), c. causing a relative movement between said preform (8) and said at least one pressure roller (7) in a direction parallel to said longitudinal axis (A) while pressing said pressure roller (7) against the preform (8) in a direction generally perpendicular to said longitudinal axis (A), characterized in that step c is performed such that material of the preform (8) is displaced by the pressure roller (7) in such a way that said mandrel (3, 4') is moved longitudinally along said longitudinal axis (A) by the displaced material.

2. The method of claim 1, characterized in that following step a, another portion of said preform (8) opposite said first portion is slidingly placed on a second mandrel (4) which is slidably mounted in parallel to said longitudinal axis (A) of the preform (8), and subsequently said first (4) and second (3) mandrels are caused to move toward one another to a position proximate each other such that the surfaces (3*b*, 4*b*) thereof disposed within the preform (8) substantially define a negative profile of the inner surface to be formed in said preform (8).

3. The method of claim 2, characterized in that said mandrels (3, 4) are coupled to each other during the pressing operation.

4. The method of claim 2, characterized in that said mandrel(s) (3, 4, 4') are, at least temporally, displaced axially and/or rotated, by material flowing from the preform (8).

5. The method of claim 4, characterized in that said displacement is in a direction of a first tool case (5) coupled to a tailstock (2) in which said first mandrel (3) is moveably mounted.

6. The method of claim 1, characterized in that said preform (8) is slidingly placed on said first mandrel (3) by means of a dog (6*a*) provided on a tool case (5, 6).

7. The method of claim 6, characterized in that said preform (8) is centered by a centering diameter (3*e*) of said first mandrel (3) when being slidingly placed on said first mandrel (3).

8. The method of claim 1, characterized in that at least one mandrel (3, 4) has a conical or double conical, tapered or double tapered outer surface (3*b*, 4*b*, 4*b'*).

9. The method of claim 1, wherein only a portion of a rotationally symmetrical preform (8) is formed.

10. A flow-forming machine comprising at least one mandrel (3, 4, 4') slidably mounted in parallel to a machine axis (MA) for slidingly receiving thereon a preform (8) to be formed, and at least one forming roller (7) for forming said preform (8), an outer surface of said at least one mandrel (3, 4, 4') being provided such that, in the area of a perform (8) placed thereon, it has a tapering portion which substantially defines a negative profile of an inner surface to be formed in said preform (8) characterized in that said at least one mandrel (3, 4, 4') is mounted such that, during a forming operation, it is displaced longitudinally along said machine axis (MA) and/or rotated by material which is displaced from the preform (8) being acted upon by said at least one forming roller (7), further characterized in that said at least one mandrel (3, 4, 4') is mounted such that, during the forming operation, it is displaced and/or rotated by material which is displaced from the preform (8) by at least one forming roller.

11. The flow-forming machine of claim 10, characterized in that it further comprises a main spindle box (1) having a tool case (6) and, associated therewith, another mandrel (4) which is slidably mounted in parallel to the machine axis (MA).

12. The flow-forming machine of claim 11, characterized in that it further comprises a tailstock (2) having, associated therewith, said at least one mandrel (3) which is slidably mounted in parallel to the machine axis (MA), wherein said pair of mandrels (3, 4) is arranged concentrically, and wherein end faces (3*c*, 4*c*) thereof face each other and the two mandrels (3, 4) taper towards said end faces (3*c*, 4*c*).

13. The flow-forming machine of claim 12, characterized in that it further comprises a second tool case (5) associated with said tailstock (2) and mounted slidably in parallel to the machine axis (MA).

14. The flow-forming machine of claim 10, characterized in that said at least one mandrel includes at least first and second mandrels, and wherein said first mandrel (3) comprises a stud (3*a*) which is insertable into a bore (4*a*) provided in said second mandrel (4), for centering therewith.

15. The flow-forming machine of claim 10, characterized in that the at least one mandrel (3, 4, 4') has a centering for the preform (8) to be placed thereon.

16. The flow-forming machine of claim 10, characterized in that a first mandrel of said at least one mandrel (4') is provided with a spreading means.

* * * * *